United States Patent [19]

DeSisto et al.

[11] 4,028,807

[45] June 14, 1977

[54] CAN OPENER LATCH FOR RELEASING CUTTING ASSEMBLY

[75] Inventors: Richard E. DeSisto; Murray M. Mikituk, both of Welland, Canada

[73] Assignee: General Signal Corporation, Rochester, N.Y.

[22] Filed: Jan. 8, 1976

[21] Appl. No.: 647,389

[52] U.S. Cl. ..... 30/419; 16/174

[51] Int. Cl.[2] ..... B67B 7/38

[58] Field of Search ..... 30/4 B, 8, 8.5, 9, 419; 16/169, 171, 174, 175, 176, 177

[56] References Cited

UNITED STATES PATENTS

| | | | |
|---|---|---|---|
| 3,654,698 | 4/1972 | Scott | 30/4 B X |
| 3,673,682 | 7/1972 | Yamamoto | 30/4 B X |

FOREIGN PATENTS OR APPLICATIONS

| | | | |
|---|---|---|---|
| 220,428 | 8/1924 | United Kingdom | 16/174 |

*Primary Examiner*—Gary L. Smith

*Attorney, Agent, or Firm*—Milton E. Kleinman; George W. Killian

[57] ABSTRACT

To facilitate the cleaning of a can opener cutter, the pivoted handle on which it is mounted is arranged for easy removal. The shaft on which the handle is pivoted has an undercut section. A keeper edge mates with the undercut section of the shaft to restrain axial motion of the shaft without inhibiting rotational motion. The inner end of the shaft cams the keeper aside to permit assembly. Although a gravity system could be used, the keeper is normally spring biased towards engagement with the undercut section of the shaft. The keeper and biasing element may constitute a single element. When a spring biased keeper is used, the shaft has a chordal segment removed between the inner end and the undercut section. Thus when the shaft is in a predetermined angular orientation, with respect to the keeper, the handle may be removed without camming the keeper aside.

16 Claims, 7 Drawing Figures

CAN OPENER LATCH FOR RELEASING CUTTING ASSEMBLY

BACKGROUND OF THE INVENTION

The present invention relates to can opener devices and more particularly to a structure and feature that permits easy removal of the cutting knife assembly of the can opener such that the cutting knife assembly and associated parts may be more conveniently cleaned.

Can openers are very common appliances in the modern kitchen and may be of either an electric or manual variety. Such can openers in household use can accumulate food on the parts associated with the can cutting operation and hence require frequent cleaning to prevent an unsanitary condition. Certain difficulties are presented in cleaning such devices because of their bulk, the proximity of the contaminated elements to other elements, their mounting and the danger of liquids and cleaning compound near electrical apparatus if the can opener is of the electric variety. The principal cleaning difficulty resides in the fact that the cutting wheel, or knife, used in such can openers is so positioned as not to permit complete and ready access to the entire cutting wheel assembly. Hence, it becomes particularly desirable that the structure which carries the cutting wheel — which is commonly in the form of a hand-operated lever arm — be readily removable from the other parts of the can opener so that thorough washing of the cutting wheel assembly can be easily accomplished. There are prior art techniques for removing the cutting wheel assembly to provide for thorough cleaning thereof. However, the prior art techniques have required manual operation of release levers and/or the inclusion of numerous extra parts, some of which are fairly expensive. These include for example: a keyhole shaped cutout and specially machined parts. U.S. Pat. No. 3,654,698 issued Apr. 11, 1972, to Scott, discloses a can opener with a removable hand lever and cutting element which provides a complicated spring latch mechanism and an eccentric cam. A prior art can opener provided a rigid and immovable keeper and, therefore, required a predetermined angular orientation of the handle to permit either handle removal or replacement. The improved mechanism of the present invention requires no more parts than the last cited structure and fewer, simpler and more economical parts than the other cited prior art structures and provided the best features of both.

SUMMARY OF THE INVENTION

The present invention employs a simple shaft attached to the handle which provides for the desired rotational motion of the handle. The shaft has an undercut portion which mates with a movable keeper edge to prevent axial motion of the shaft. The shaft has a chordal section removed therefrom to permit axial removal of the shaft only when the shaft is in a predetermined angular orientation such that the removed chordal section is in alignment with the keeper edge, thereby allowing the shaft to be withdrawn. Obviously, the shaft may be reassembled to the can opener when the shaft is in the mentioned predetermined angular orientation. However, the keeper is gravity or spring biased and the end of the shaft is rounded so that any portion thereof can cam the keeper aside until the shaft is fully inserted and the keeper can snap into the undercut section of the shaft. The keeper may assume any of a wide variety of simple and economical structures.

It is an object of the invention to provide a new and improved can opener.

It is a more particular object of the invention to provide a new and improved can opener having an easily removed handle.

It is another object of the invention to provide a can opener structure which allows removal of the handle when in a predetermined orientation with respect to the keeper.

It is another object of the invention to provide an improved can opener which allows reassembly of the handle to the can opener without any regard for the angular orientation of the handle at the time of assembly.

It is another object of the invention to provide a retaining means which may be readily cammed aside during assembly, but which does not require a camming motion to permit disassembly.

The above objects are fulfilled and the advantages of ready removal of parts is achieved by providing a unique structure for the lever arm which carries the cutting wheel assembly. In one embodiment, the lever arm is so constructed that it may be removed from the frame assembly simply by rotating the shaft of the lever arm to a predetermined angular orientation. When assembled, the shaft extends through a bore provided in the frame and the bore has at its inner end a keeper which defines a D-shaped opening at or near the inner end. Correspondingly, the shaft has its inner end shaped in the form of a D so that when the shaft is properly oriented, the end of the shaft can move through the defined opening without interference. The shaft has an undercut section which is positioned for engagement by the aforesaid keeper to prevent axial movement of the shaft when the shaft is in any angular orientation other than that previously mentioned. Accordingly, the shaft may be moved longitudinally and extracted from the frame, only if it is at the previously mentioned predetermined angular orientation. However, the angle of orientation is not critical for assembly. The keeper may be gravity or spring biased and the end of the shaft is appropriately shaped so that the keeper may be cammed aside when the shaft is inserted into the bore. This allows insertion of the shaft at any angle. When a gravity biased keeper is employed, the shaft does not need to have a chordal segment removed to form a D-shaped section as the keeper can be moved out of engagement with the undercut section of the shaft by inverting the entire mechanism. The use of a spring bias and the removal of a chordal segment is considered more convenient.

Other objects, advantages and features of the present invention will be readily appreciated as the invention becomes better understood by reference to the following detailed description of a preferred embodiment of the invention when considered in connection with the accompanying drawing.

Like parts have like numbers in all views. Elements shown in alternate structures which do not correspond identically with elements shown in other views, but which have a relationship or common function, have been given an identifying number which corresponds with that of the element to which it most nearly corresponds, except that the number has been preceded with a digit that corresponds to the figure number. For example, element number 727 in FIG. 7 corresponds in function, but is not identical with element 27 in FIGS. 1, 2, 3 and 4.

DESCRIPTION OF THE PREFERRED EMBODIMENT

Figure 3:
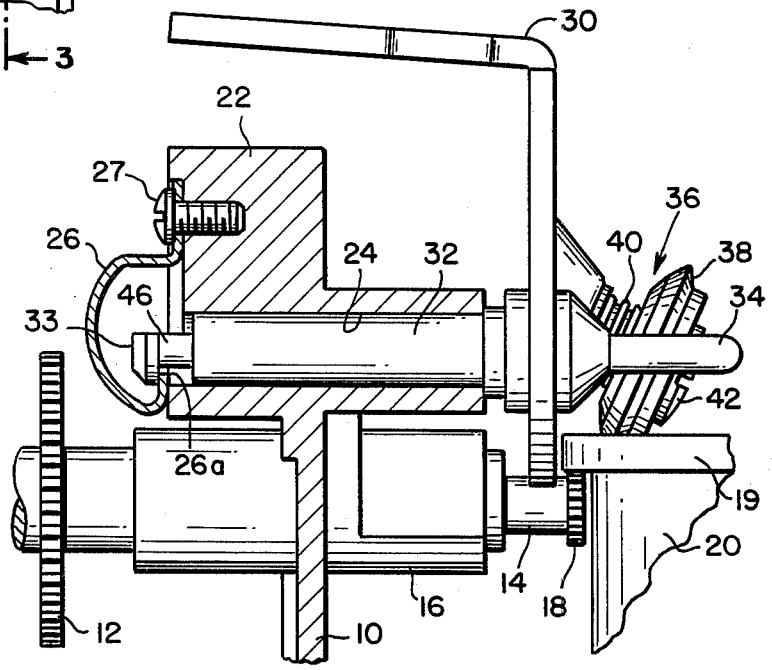
FIG. 3 is an enlarged sectional view taken on the line 3—3 in FIG. 2.

Referring now to the drawing, and particularly FIG. 3, there will be seen a frame or body portion 10 to which the several parts of the can opener are affixed. In particular, a drive gear 12 is mounted at the inner end of a shaft 14 which extends through a suitable bore in boss 16 which is integral with the frame 10. The boss 16 can be seen to extend inwardly and outwardly in perpendicular relationship with the frame 10. At the other end of the boss 16, mounted to the same shaft 14, is a small tooth drive wheel 18 for the purpose of engaging bead 19 on the rim of a can 20 to be opened (see FIG. 3). The drive gear 12 may be turned in a conventional manner by a motor (not shown) coupled to drive gear 12. Or, by any convenient mechanism, the drive gear 12 may be turned in response to the operation of a hand crank (not shown).

Figure 1:
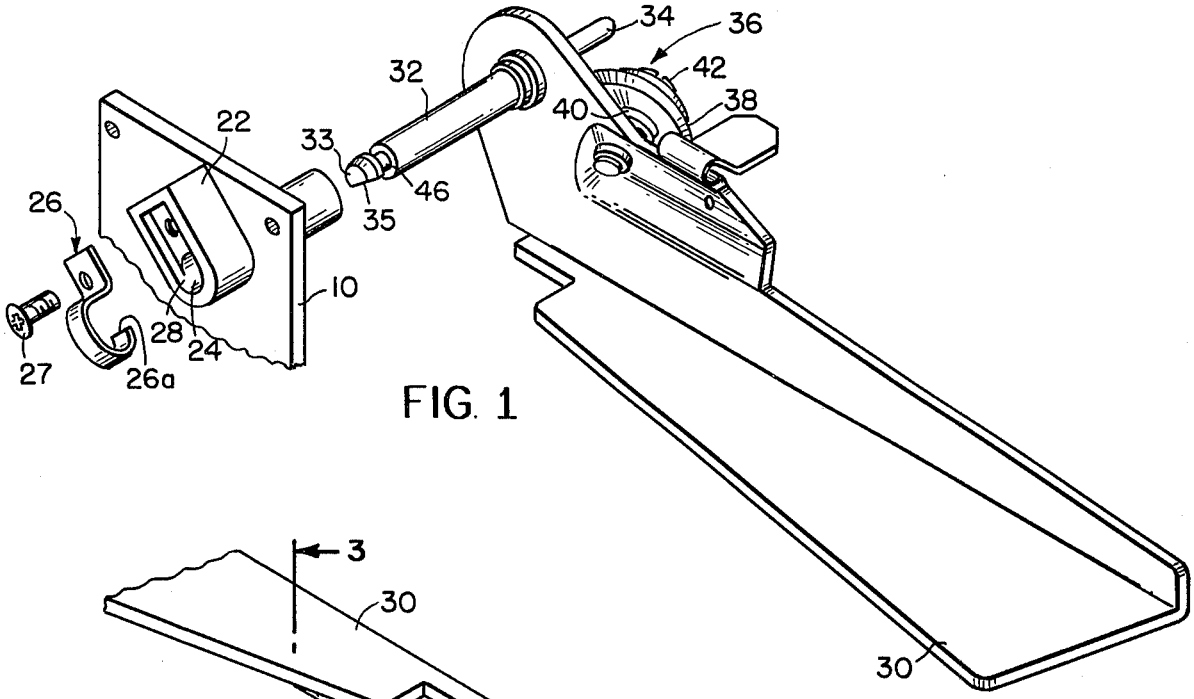
FIG. 1 is an exploded view of a portion of a can opener illustrating the lever arm removed from the frame of the can opener, the lever arm being at the proper angle for removal of its shaft from the frame.
Figure 2:
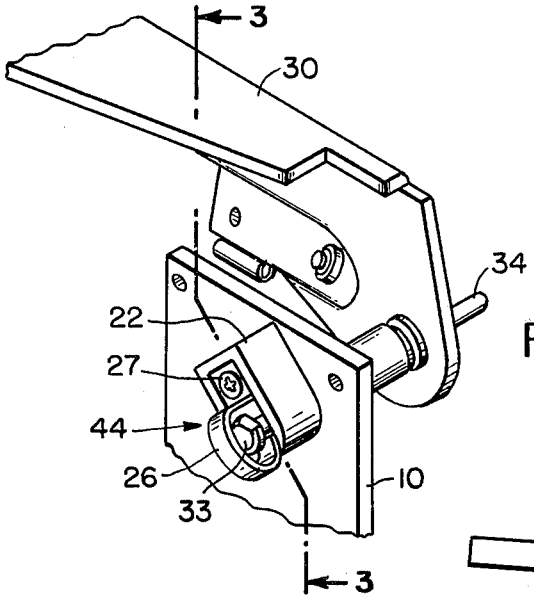
FIG. 2 illustrates the lever arm with its shaft inserted into the bore of the frame and with the shaft having the angular orientation of an assembled can opener ready for use.

Another boss 22, likewise extending to either side of the frame 10, is provided near the upper part (as seen in FIGS. 1 and 2) of the frame 10 and has a bore 24 therethrough. At the inner end of the bore 24, a keeper 26 is secured by a screw 27, and disposed to define a D-shaped channel or opening 28 most easily seen and visualized in FIG. 1 and serving purposes to be described. A lever arm 30 is rotatably mounted in the frame 10 by means of the shaft 32 which projects inwardly from the inner side of the lever arm 30. At the outer side, a stud 34 is provided for guiding the can 20 into operative relationship with the cutter 38 and other can opening elements. Carried at the lower end of the lever arm 30, near the stud 34, is a cutting wheel assembly 36 comprising a cutting wheel 38, a spring 40, and a bolt 42 for suitably mounting the cutting wheel 38 for rotational movement.

The lever arm 30 is normally kept in the frame 10 by a holding mechanism 44. The inner end 33 of the shaft 32 is D-shaped so as to match the shape of the channel or opening 28, a chordal segment having been removed from the end of the shaft 32 to an axial distance as may be required to provide suitable mating of elements. A section 46 of the shaft 32 adjacent the end 33 is undercut, that is, it is provided with a reduced diameter. This section 46 extends axially for a suitable distance to provide the mating relationship with other parts in the manner to be more fully described hereinafter.

With the above-described configuration, when the lever arm 30 is oriented, as shown in FIG. 1, the shaft 32 can be readily removed since the configuration permits the end 33 of the shaft 32 to pass through the D-shaped opening 28. The deepest penetration of the shaft 32 within the bore 24 can be seen by reference to FIGS. 2 and 3 wherein the end 33 of shaft 32 passes just beyond the keeper edge 26*a*. As can be seen by reference to FIGS. 2 and 3, when the lever arm 30 is rotated away from the position shown in FIG. 1 and to the normal operating position of FIG. 2, the shaft 32 will be precluded from axial movement because undercut section 46 of the shaft 32 will be engaged by the keeper edge 26*a* of the keeper 26.

The keeper 26 of FIGS. 1 through 4 is made of spring metal and while the lever arm 30 may be assembled in the manner described, it will be appreciated that the lever arm may be assembled with the frame 10 and with the undercut section 46 engaged with the keeper edge 26*a* by inserting the shaft 32 into the bore 24 without any regard for the angular orientation of the shaft 32 with respect to the D-shaped opening 28. That is, as shown more clearly in FIG. 4 as the shaft 32 is inserted into the bore 24, the end 33 of the shaft 32 has a cam surface 33*a* which contacts the keeper edge 26*a* and pushes it aside and slightly deforms the keeper 26 until the shaft 32 is inserted to a sufficient depth to allow the keeper edge 26*a* to spring into the position shown in FIG. 3 and towards the undercut section 46. When the shaft 32 and keeper 26 are in the relationship shown in FIG. 3, axial motion of the shaft 32 is inhibited except when the shaft 32 is rotated to the orientation shown in FIG. 1. When the shaft 32 is inserted to sufficient depth and the keeper edge 26*a* enters the undercut section 46, a distinct click will be heard thereby providing an audible indication of complete and satisfactory reassembly. Normally, the keeper edge 26*a* will not be in contact with the reduced diameter section 46 of the shaft 32.

Figure 4:
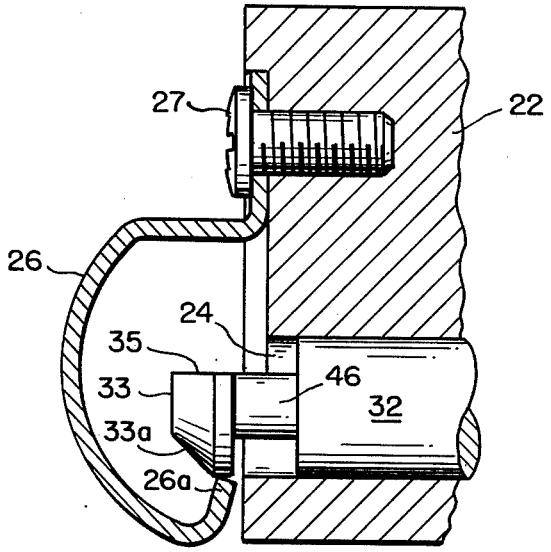
FIG. 4 is an enlarged fragmentary view of a portion of FIG. 3 showing the cooperation of the shaft and spring as the shaft is being assembled to the can opener.
Figure 6:
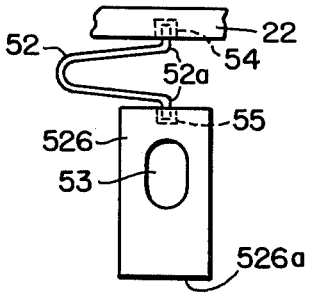
FIG. 6 shows a side view of another alternate structure similar to the structure of FIG. 5.
Figure 5:
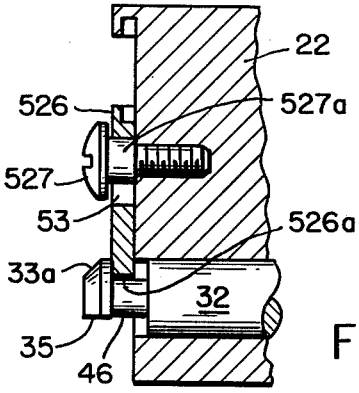
FIG. 5 illustrates an alternate structure that could be substituted for that of FIG. 4.

FIGS. 5 and 6 provide views of two other alternate structures which provides the same features as that shown in FIGS. 1 through 4. The structures shown in FIGS. 5 and 6 are enlarged fragmentary views of alternate structures which could be substituted for that part of the can opener structure shown in FIG. 4. Instead of using a spring keeper 26 as shown in FIG. 4, a reciprocating plate 526 having a keeper edge 526*a* is used. The keeper plate 526 may be spring biased towards engagement of the keeper edge 526*a* with the undercut section 46 by spring means 52. The keeper plate 526 is retained in position by screw 527 (as illustrated with respect to FIG. 5) which has a shoulder 527*a* which passes through elongated slot 53 of keeper 526. The spring 52 is retained in position by having its ends 52*a* in wells 54 and 55 of the boss 22 and keeper plate 526. It will be evident that on assembly, the cam edge 33*a* will cause the keeper plate 526 to move upward (as viewed in FIG. 6) against the force of spring 52 and allow insertion of the shaft 32 into the bore 34 without any regard for the angular orientation of the shaft 32 with respect to the frame 10. However, as with the structure illustrated in FIGS. 1 through 4, the shaft 32 cannot be withdrawn from the bore 34 until the lever arm 30 is located to a position so that the flat edge 35 of the end 33 of the shaft 32 is in alignment with the keeper edge 526a of the keeper plate 526. It will be apparent that the flat edge 35 of the shaft 32 must be appropriately positioned with respect to the lever arm 30 so that the shaft 32 may be withdrawn when the lever arm 30 is in the position shown in FIG. 1. Furthermore, the position of the flat edge 35, with respect to the lever arm 30, differs in the structure of FIGS. 4 and 5. That is, as will be seen in FIG. 4, the keeper edge 26a enters the notch 46 from a bottom position of the shaft 32 while the keeper edge 526a enters the undercut section 46 from an upper position with respect to the shaft 32. The limits of the slot 53 contact the shoulder 527a of the screw 527 and may limit the movement of the keeper edge 526a towards the reduced diameter section 46 of the shaft 32.

It will be apparent that the spring 52 of FIG. 6 could be eliminated if the assembly is such that the keeper 526 moves to engage the undercut section 46 by the force of gravity. FIG. 5 illustrates this option. The structure of FIG. 5 is similar to that of FIG. 6, except for the omission of the spring 52. Furthermore, it would not be necessary to remove the chordal segment of the shaft 32 to form the flat edge 35 if it was considered satisfactory to invert the can opener to let gravity withdraw the keeper 526 from the undercut section 46. If a gravity system is used, the keeper 526 should be mounted by a minimum friction means.

Figure 7:
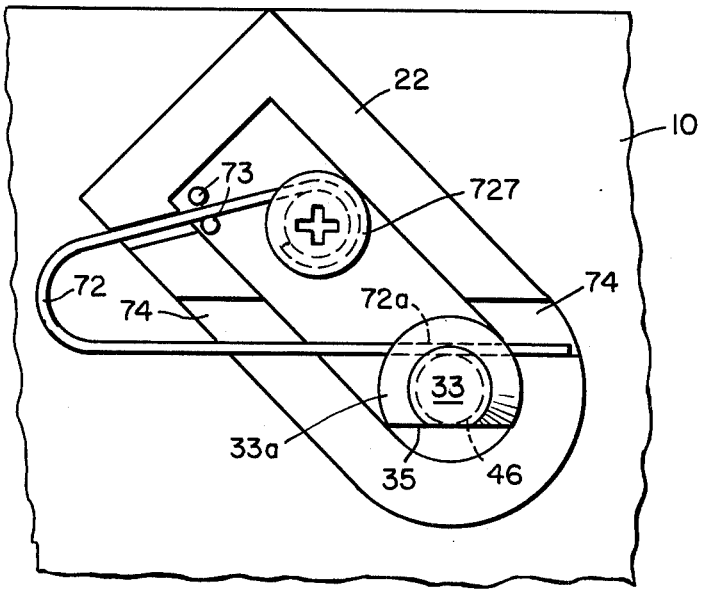
FIG. 7 illustrates another alternate structure which could be used.

FIG. 7 illustrates another alternate form of the invention. FIG. 7 constitutes an end view of the boss 22 as seen in FIG. 2 and as modified for this alternate structure. In this alternate structure, a spring 72, anchored at one end by screw 727, is used as the keeper. Portion 72a of the spring 72 constitutes the keeper edge and may enter the undercut section 46 of the shaft 32 after the shaft 32 has been inserted into the bore 34. The keeper edge 72a of the spring 72 is cammed upward (as seen in FIG. 7) by the cam surface 33a of the end 33 of shaft 32 during assembly to deform the spring 72. Studs 73 may be used to help stabilize and position the spring 72. Notches 74 in the boss 22 provide for placement of the spring 72 and limit the downward motion of the keeper edge 72a. The notches 74 must be sufficiently wide to allow the necessary upward motion of the keeper edge 72a during assembly.

While there has been shown and described what is considered at the present to be the preferred embodiment of the invention, modification thereto will readily occur to those skilled in the related arts. For example, in another structure, springs of different shapes and/or having different anchoring means could be used. In addition, the keeper edges could have an arcuate shape instead of being straight. It is believed that no further analysis or description is required and that the foregoing so fully reveals the gist of the present invention that those skilled in the applicable arts can adapt it to meet the exigencies of their specific requirements. It is not desired, therefore, that the invention be limited to the embodiments shown and described, and it is intended to cover in the appended claims all such modifications as fall within the true spirit and scope of the invention.

We claim:

1. In a can opener mechanism having a frame member, a drive wheel, a means for rotating said drive wheel and in combination therewith:

a. a hand lever carrying a cutting element and a shaft;

b. said shaft coupled to said hand lever at one end and having an undercut section proximate to the other end thereof;

c. a bore in said frame member for journaling said shaft;

d. a keeper intersecting a portion of said bore and supported for movement away from intersection with said bore in response to insertion of said shaft into said bore and then to return to intersection with said bore for engagement with said undercut section to inhibit axial removal of said shaft; and wherein e. said shaft has a segment removed therefrom between said undercut section and said other end for enabling axial removal of said shaft only when said shaft is in a predetermined angular orientation such that the removed segment creates a condition of non-engagement between said keeper and said shaft.

2. The combination as set forth in claim 1, wherein said keeper constitutes a spring element having a keeper edge biased towards engagement with said undercut section of said shaft.

3. The combination as set forth in claim 2, wherein the end of said shaft first inserted into said bore coacts with said keeper edge to move said keeper against said bias for permitting entry of said shaft into said bore when the angular orientation of said shaft is other than said predetermined angular orientation.

4. The combination as set forth in claim 1, wherein said keeper comprises a reciprocating plate.

5. The combination as set forth in claim 4, wherein said other end of said shaft constitutes a cam for camming said keeper away from intersection with said bore in response to the insertion of said shaft into said bore.

6. The combination as set forth in claim 5, wherein said keeper is spring biased towards engagement with said undercut section.

7. The combination as set forth in claim 5, wherein said keeper is oriented to seek engagement with said undercut section as a result of the force of gravity.

8. In a can opener having a frame member, a rotary feed wheel, means for rotating said feed wheel, and in combination therewith:

a. a hand lever carrying a cutting element thereon;

b. a shaft member extending from said hand lever, said shaft member removably insertable in a bore in said frame member and rotatable therein to pivotally mount said hand lever on said frame member for allowing pivotal motion of said cutting element towards and away from said feed wheel;

c. an undercut section of said shaft member;

d. a deformable keeper supported on said frame member and having a keeper edge for engagement with said undercut section of said shaft to restrict axial motion of said shaft without restricting rotational motion of said shaft; and wherein e. said shaft has a segment removed therefrom or permitting axial movement of said shaft past said keeper only when said shaft is in a predetermined angular orientation.

9. The combination as set forth in claim 8 and including spring bias means for urging said keeper into engagement with said undercut section.

10. The combination as set forth in claim 9, wherein the end of said shaft first inserted into said bore is proportioned to deform said keeper and move said keeper edge away from its position of potential engagement with said undercut section for permitting insertion of said shaft into said bore at a random angle of orientation.

11. The combination as set forth in claim 10, wherein said keeper and said spring bias means constitute a unitary structure.

12. In a can opener having a frame member, a rotary feed wheel, means for rotating said feed wheel, and in combination therewith:

a. a hand lever carrying a cutting element thereon;

b. a shaft member extending from said hand lever, said shaft member removably insertable in a bore in said frame member and rotatable therein to pivotally mount said hand lever on said frame member for allowing pivotal motion of said cutter towards and away from said feed wheel;

c. a uniformly undercut section of said shaft member extending around the circumference thereof;

d. a keeper supported on said frame member for longitudinal reciprocal motion and engagement with said undercut section of said shaft to restrict axial motion of said shaft except when said shaft is in a predetermined axial orientation without restricting rotational motion of said shaft when said keeper is at one limit of its reciprocal motion; and wherein e. when said keeper is at another limit of its reciprocal motion, said keeper is out of engagement with said undercut section of said shaft for, thereby, allowing axial movement of said shaft past said keeper irrespective of the angular orientation of said shaft.

13. The combination as set forth in claim 12, wherein said keeper is moved between said one limit and said other limit by the force of gravity.

14. The combination as set forth in claim 12 and including bias means for urging said keeper towards said one limit.

15. The combination as set forth in claim 12 and including means for said shaft to coact with said keeper and move it from said one limit towards said another limit in response to the insertion of said shaft in said bore when said shaft is not at said predetermined axial orientation.

16. The combination as set forth in claim 12, wherein said shaft has a chordal segment removed therefrom for permitting axial movement of said shaft past said keeper and out of said bore while said keeper is at said one limit and said shaft is at a predetermined angular orientation.

* * * * *

UNITED STATES PATENT AND TRADEMARK OFFICE

CERTIFICATE OF CORRECTION

PATENT NO. : 4,028,807

DATED : June 14, 1977

INVENTOR(S) : Richard E. DeSisto & Murray M. Mikituk

It is certified that error appears in the above-identified patent and that said Letters Patent are hereby corrected as shown below:

Claim 8, clause e), line 1, (column 6, line 55) delete "or" and substitute therefor --for--.

Claim 12, clause d), line 5, (column 7, line 20) delete "axial" and substitute therefor --angular--.

Signed and Sealed this

*Seventeenth* Day of *October 1978*

[SEAL]

*Attest:*

RUTH C. MASON
*Attesting Officer*

DONALD W. BANNER
*Commissioner of Patents and Trademarks*